US010692408B1

(12) United States Patent
Johnson

(10) Patent No.: US 10,692,408 B1
(45) Date of Patent: Jun. 23, 2020

(54) ELECTRONIC HUB DEVICE

(71) Applicant: Melvin Johnson, Dallas, TX (US)

(72) Inventor: Melvin Johnson, Dallas, TX (US)

( * ) Notice: Subject to any disclaimer, the term of this patent is extended or adjusted under 35 U.S.C. 154(b) by 0 days.

(21) Appl. No.: 16/378,748

(22) Filed: Apr. 9, 2019

Related U.S. Application Data

(63) Continuation-in-part of application No. 16/163,797, filed on Oct. 18, 2018.

(51) Int. Cl.

| | |
|---|---|
| ***G09F 13/18*** | (2006.01) |
| ***F21V 33/00*** | (2006.01) |
| ***F21V 23/04*** | (2006.01) |
| ***F21S 9/02*** | (2006.01) |
| ***G08B 7/06*** | (2006.01) |
| ***G09F 27/00*** | (2006.01) |
| ***G09F 13/34*** | (2006.01) |
| ***G09F 23/00*** | (2006.01) |
| ***G09F 13/00*** | (2006.01) |
| ***F21Y 115/10*** | (2016.01) |

(52) U.S. Cl.
CPC ..... *G09F 13/18* (2013.01); *F21S 9/02* (2013.01); *F21V 23/045* (2013.01); *F21V 23/0471* (2013.01); *F21V 33/00* (2013.01); *G08B 7/06* (2013.01); *G09F 13/005* (2013.01); *G09F 13/34* (2013.01); *G09F 23/00* (2013.01); *G09F 27/005* (2013.01); *F21Y 2115/10* (2016.08); *G09F 2023/005* (2013.01); *G09F 2027/001* (2013.01)

(58) Field of Classification Search
CPC ..... G09G 3/005
USPC ..... 340/851.45
See application file for complete search history.

(56) References Cited

U.S. PATENT DOCUMENTS

| | | | | |
|---|---|---|---|---|
| 6,072,386 | A * | 6/2000 | Yu | B62J 6/20 340/432 |
| 2007/0228807 | A1 | 10/2007 | Leslie | |
| 2008/0101053 | A1* | 5/2008 | Hoffman | G09F 21/045 362/35 |
| 2009/0015057 | A1* | 1/2009 | Groomes | B60Q 1/326 301/37.108 |
| 2013/0334961 | A1* | 12/2013 | Frankovich | B60Q 1/326 315/77 |
| 2017/0190083 | A1* | 7/2017 | Zhou | B29C 45/14 |

* cited by examiner

*Primary Examiner* — Fabricio R Murillo Garcia
(74) *Attorney, Agent, or Firm* — Sanchelima & Associates, P.A.; Christian Sanchelima; Jesus Sanchelima

(57) ABSTRACT

The present invention is an electronic hub device that comprises a frame mounted on a pole structure of an object. The frame comprises one or more sensors configured to detect one or more events around the electronic hub device, and a plurality of light sources installed along a boundary of the frame configured to illuminate a portion of the frame within the boundary of the frame. A portion of frame includes promotional content selected based on user preferences. The frame further comprises a processor configured to activate plurality of light sources upon detection of one or more events. The present invention exists in an alternate embodiment in which a poster is used to display the desired promotional content of a user. The poster in this embodiment is either displayed through the use of rings or through being mounted onto a frame of the electronic hub device. This allows the promotional content to be changed as frequently as a user desires.

5 Claims, 9 Drawing Sheets

ELECTRONIC HUB DEVICE

OTHER RELATED APPLICATIONS

The present application is a continuation-in-part and claims the benefit of the priority date of the pending U.S. patent application Ser. No. 16/163,797, filed on Oct. 18, 2018, which is hereby incorporated by reference.

BACKGROUND OF THE INVENTION

Field of the Invention

The present disclosure relates to an electronic hub device. More particularly, the present disclosure relates to an electronic hub device configured to be installed on a plurality of objects.

Description of the Related Art

Simply put, a hubcap is a cover placed on the "hub", which is the central portion of a rotating object, such as a wheel. Hubcap is usually a small cover made of metal or plastic that safeguards the lug nuts from dirt and moisture and also prevents the lug nuts from falling out. Hubcaps are mostly decorative accessories noted to give the rotating objects an overall attractive, tidier, and stylish appearance.

Several designs of such hubcaps have been presented in the past. None of them, however, presents a simple, creative, interactive, and promotional electronic hub device that may be designed and customized based on user preferences and which could be mounted on generic objects, like chairs, in a facility, such as workstation, game room, man caves, sports bar, business place, shop, salon, retail stores, restaurants, or other such place.

Applicant believes that a related reference corresponds to U.S. patent number US20070228807A1 filed by Jerry Leslie that discloses a customized hubcap attachment system to provide interchangeable hubcaps allowing use of different ornamental hubcaps for different occasions. The hubcap attachment system includes a wheel with an interior rim, a hubcap mount attachable to wheel interior rim, and a hubcap plate removably attachable to the hubcap mount. However, such hubcaps are targeted to only enhance aesthetic appearance of a wheel.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide an electronic hub device, comprising a frame mounted on a pole structure of an object, wherein frame comprises one or more sensors configured to detect one or more events around hub device, a plurality of light sources installed along a boundary of frame configured to illuminate a portion of frame within boundary of frame, wherein portion of frame includes promotional content selected based on user preferences, a processor configured to activate plurality of light sources upon detection of one or more events, and a battery configured to provide power to plurality of light sources.

In an embodiment, a central axis of frame coincides with longitudinal axis of pole structure of object. One or more sensors are one or more of a motion sensor, an audio sensor, a proximity sensor, or a pressure sensor. One or more events correspond to a presence of another object within proximity of hub device, a movement of other object within proximity of hub device, a voice command, an audio gesture, or a pressure exerted on object.

In an embodiment, hub device further comprises a remote device, communicably coupled with hub device, configured to control one or more operations of hub device. One or more operations may correspond to switching on hub device, switching off hub device, controlling a speaker device installed on hub device, or controlling a rotation of hub device.

In an embodiment, battery is powered from an external power supply. The processor is further configured to activate an electric motor installed at inner portion of frame. Electric motor is configured to rotate frame about a central axis of frame around pole of object upon receiving an activation signal from processor. Processor is further configured to activate a speaker device installed at inner portion on upper surface of frame, wherein speaker device is configured to pair with one or more portable devices to generate an audio output.

In an embodiment, the present invention can be retrofitted onto chairs of any size or shape base. In this embodiment there can be a use of advertising posters. Importantly, in this embodiment there is the usage of two rings of different sizes. These rings are configured in such a manner that the bottom ring creates a base as it is larger. This bottom ring has a lip wherein the bottom of posters secure into. There is a second smaller ring which is the top ring. The top ring helps to extend the poster. Which means that the advertisement poster is extended by and in-between the bottom ring and the top ring so that the advertisement on the poster can be seen. Retrofitting of the present invention to any existing chair is possible as the top and bottom rings come apart. Each of the rings split into two parts which then come together once they have been fitted around the necessary base of any chair. Further, there can be a transparent cover that can be made of plastic, plexiglass or the likes. This cover serves to simply protect the advertising poster from damage. Although "rings" is used to describe the top and bottom ring they can be of any size or shape other than circular as might be implied by "rings". That being the case, that also means that the posters can take any shape or form to properly fit into this embodiment of the present invention.

In an alternate embodiment, the present invention can be retrofitted onto chairs of any size or shape. Much like previous embodiments there is a use of a hub. However, designs are not made directly and permanently onto the hub. Instead advertising posters of various designs are used to be placed onto this hub. The posters are of the owner's choice and can be made of any of a variety of materials. These posters slip into slits found on the hub which permit the posters to be extended and held in place. Further, this hub can work much like a light box to bring light and colors to the advertising posters. The hub can be retrofitted around chairs of any shape and size as it comes apart to go around the necessary base of any chair. The hub can take any shape or size necessary as it can be fitted around any chair and its base. The posters can also take any shape or size to properly fit onto the aforementioned hub of this present invention in this embodiment. Further, there can be a transparent cover, made of plastic, plexiglass or the likes, used to protect the posters from damage.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE EMBODIMENTS OF THE INVENTION

Figure 1:
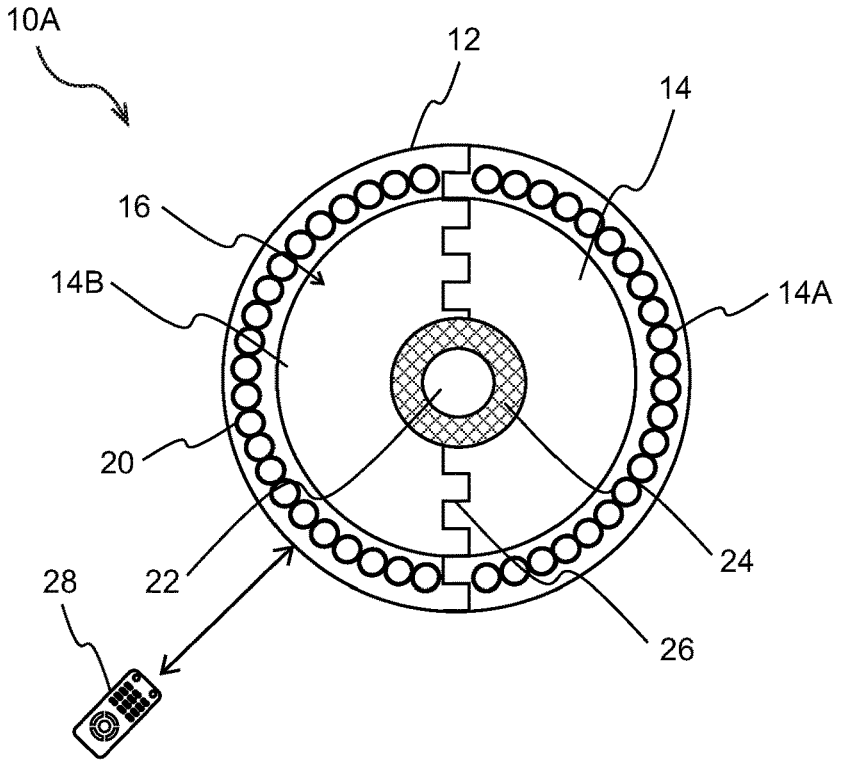
FIGS. 1, 1A and 1B represent a top, bottom, and top split views respectively of an electronic hub device, according to an embodiment described herein.

Referring now to the drawings, FIGS. 1-4I, where the present invention is generally referred to with numeral 12, it can be observed that an electronic hub device, in accordance with one embodiment, is provided that includes various components, a described hereinafter.

Figure 1A:
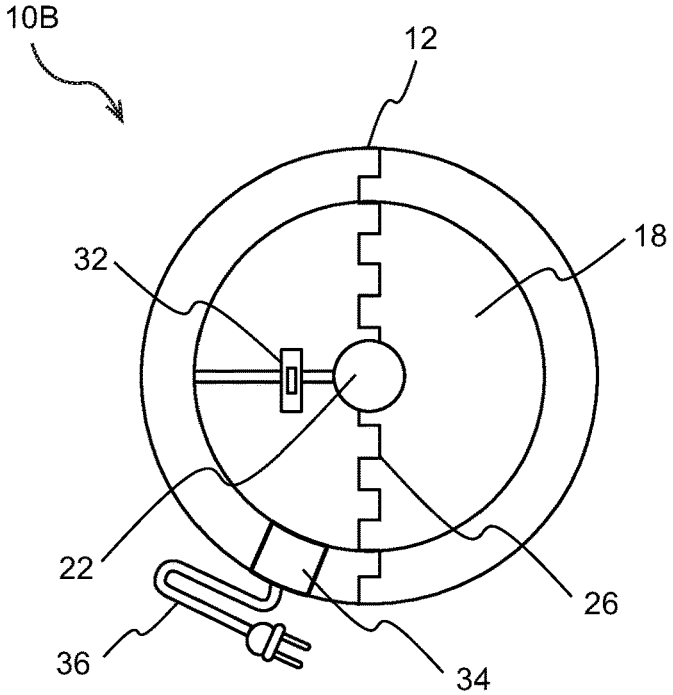

FIG. 1 represents a top view 10A of electronic hub device 12 and FIG. 1A represents a bottom view 10B of said electronic hub device 12, according to an embodiment described herein.

Referring to FIG. 1, there is shown top view 10A of upper surface 16 of a frame 14 of said electronic hub device 12. Frame 14 has a boundary portion 14A and an inner portion 14B within said boundary portion 14A of said frame 14. Boundary portion 14A includes a plurality of light sources 20, for example light emitting diodes (LEDs) or other such light emitting components. Inner portion 14B of said frame 14 comprises an area on which promotional content, selected by a user based on user preferences, may be affixed.

Figure 3:
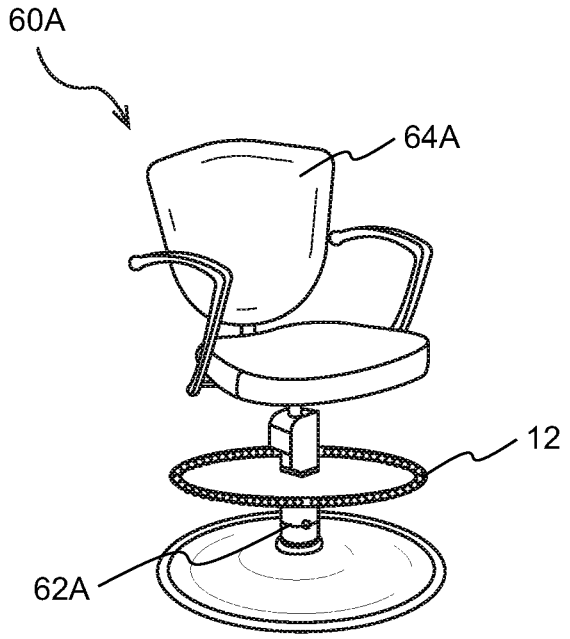
FIGS. 3-3D represent multiple objects upon which electronic hub device may be mounted, according to an embodiment described herein.
Figure 3A:
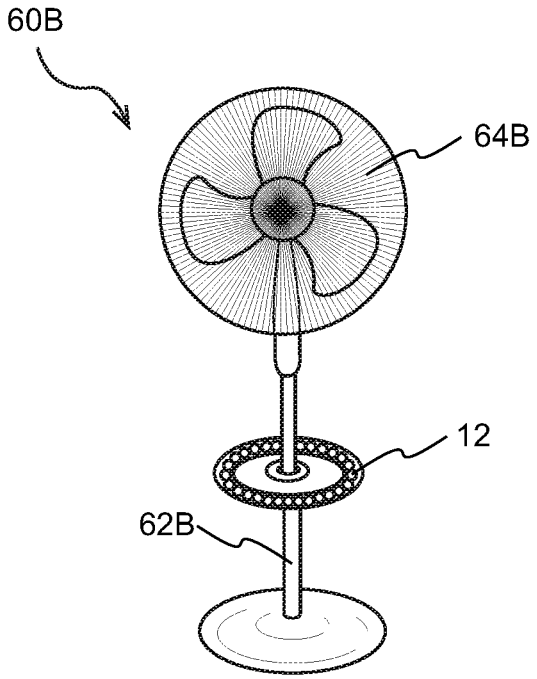
Figure 3B:
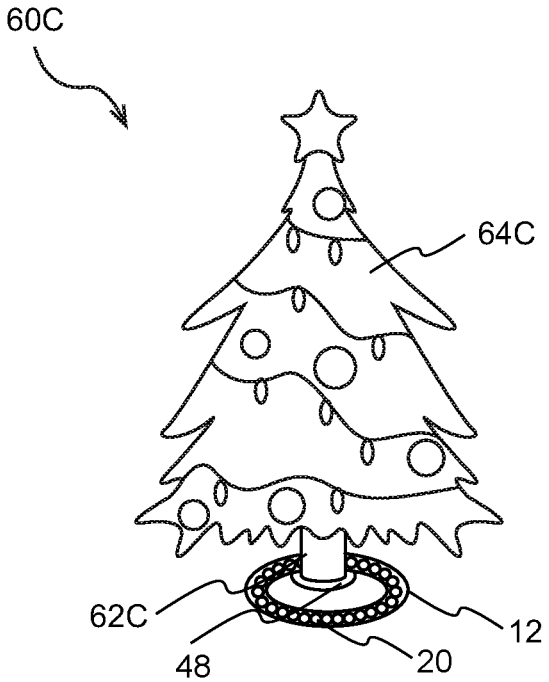
Figure 3C:
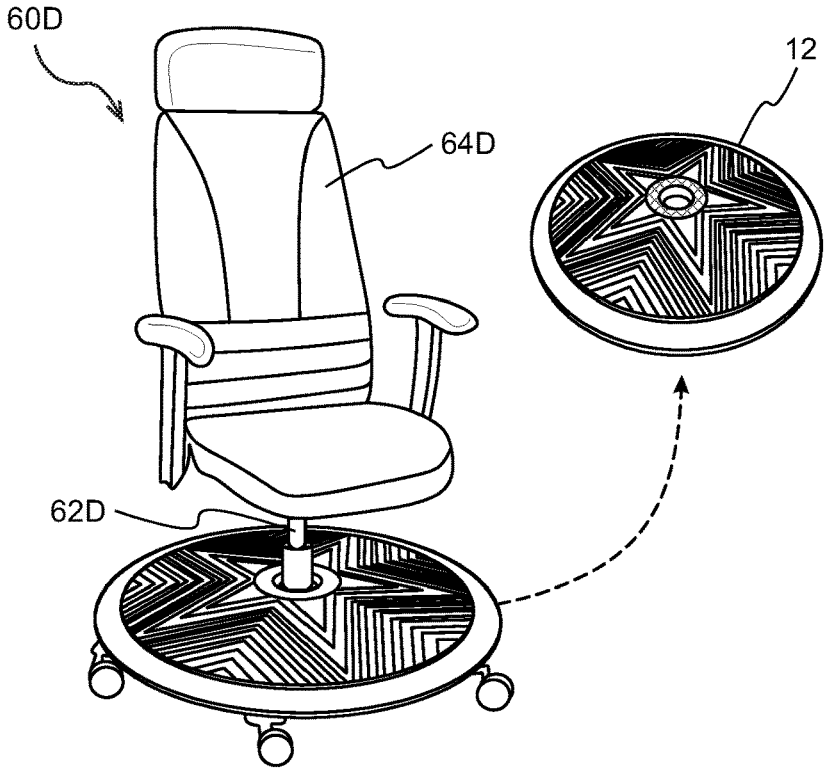
Figure 3D:
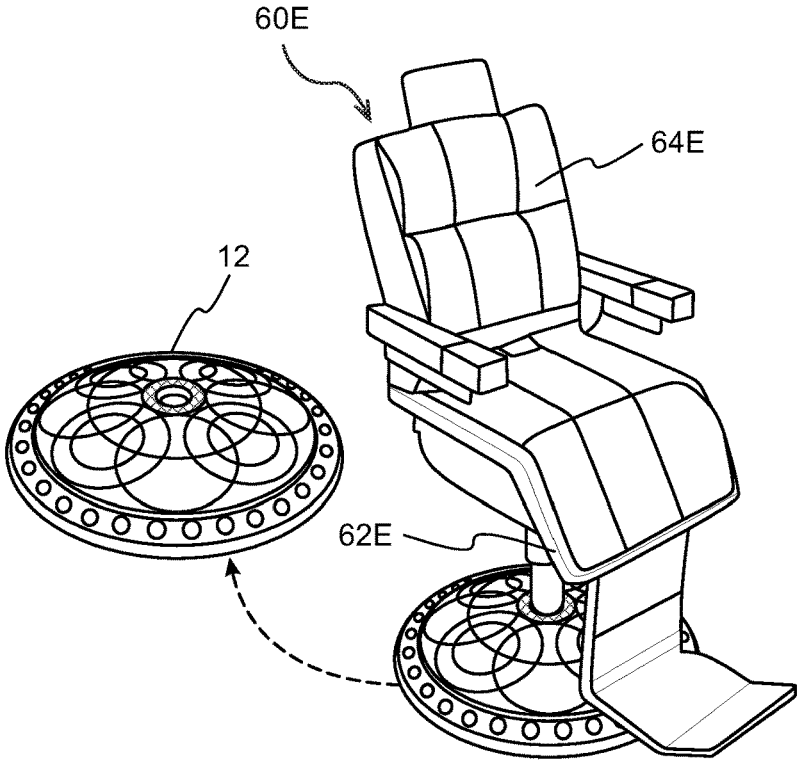

At center of said frame 14, there is a cavity 22 configured to be engaged with a pole structure of an object, further illustrated in FIGS. 3-3D. Around said cavity 22, there may be located a wireless speaker device 24, such as a Bluetooth speaker, that may be configured to be paired with one or more portable devices to generate audio outputs. Frame 14 of said electronic hub device 12 may include a connector 26 at which said frame 14 may be unassembled while mounting on pole structure of object, and may be assembled once mounted on pole structure of object. Connector 26 may be an interlocking seam extending through center of said frame 14. Frame 14 of said electronic hub device 12 may be mounted in such a manner that a central axis of said frame 14 coincides with longitudinal axis of pole structure of object. There is further shown a remote device 28, communicably coupled with said electronic hub device 12, configured to control one or more operations of said electronic hub device 12. One or more operations may correspond to switching on or off said electronic hub device 12, controlling said wireless speaker device 24 installed on said electronic hub device 12, or controlling a rotation of said electronic hub device 12.

Referring to FIG. 1A, there is shown bottom view 10B of lower surface 18 of said frame 14 of said electronic hub device 12. Cavity 22 and connector 26, as illustrated, may be similar to the ones described in FIG. 1. There are further shown a plurality of clamps 32 configured to fix or hold said electronic hub device 12 in place, once mounted on pole structure of object. Apart from said clamps 32, there may be other mechanical or fluidic means to fix or hold said electronic hub device 12 in place on pole structure of object at a desired height. There is further shown a battery 34 configured to provide power to said plurality of light sources 20, said wireless speaker device 24, electric motors, and sensors, upon activation. Battery 34 may be powered from an external power supply via a power cable 36. There may be other electronic components also that may be mounted on said lower surface 18 of said frame 14 to maintain aesthetic appeal of said electronic hub device 12. For example, there may be one or more sensors configured to detect one or more events around said electronic hub device 12, a processor configured to activate said plurality of light sources 20 upon detection of one or more events, an electric motor configured to rotate said frame 14 about central axis of said frame 14 around pole structure of object upon receiving an activation signal from a processor, described in detail in FIG. 2.

In an embodiment, material of said frame 14 of said electronic hub device 12 may be durable plastic, shape may be circular, and size may be anywhere between 24 inches to 32 inches. Frame 14 of said electronic hub device 12 may be integrated with electrical and lighting components. Inner portion of said frame 14 may be decorated with various colors and artistic designs. However, the disclosure may not be so limiting, and other lightweight materials, colors, styles, shapes, and sizes may also be contemplated, without deviation from the scope of the disclosure. The overall idea of the present disclosure is to provide said electronic hub device 12 that, by use of various means, such as light show and audio rendering, may provide user an opportunity, by displaying name and logo of business imprinted on said frame 14, to display their brands, personality, creativity, and professional engagements in a more aesthetically appealing manner, and giving other users, such as customers or clients, a delightful user experience.

Figure 1B:
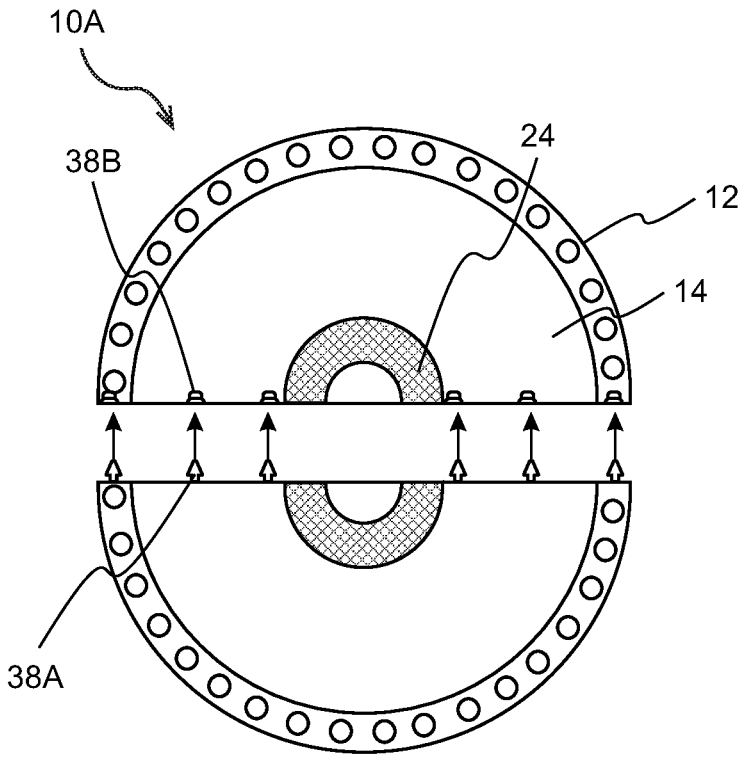

Referring to FIG. 1B, there is shown split top view 10A of upper surface 16 of said frame 14 of said electronic hub device 12. Frame 14 of said electronic hub device 12 is shown to be unassembled along interlocking seam connector 26 which is extending through center of said frame 14, while mounting on pole structure of object. Frame 14 of said electronic hub device 12 may be unassembled by pulling interlocking seam to allow disengagement of said frame 14 at boundary of said cavity 22 from pole of chair. Frame 14 of said electronic hub device 12 may be assembled by adjusting two split boundaries of said cavity 22 to snugly fit along pole of object, such as a chair, and snap fit once mounted on pole structure of object. Snap fitting may be performed using lock stick-out end 38A positioned on one half of said frame 14 and lock insert end 38B positioned on other half of said frame 14. Thus, said cavity 22 of said frame 14 may snugly fit around bottom of pedestal.

Figure 1C:
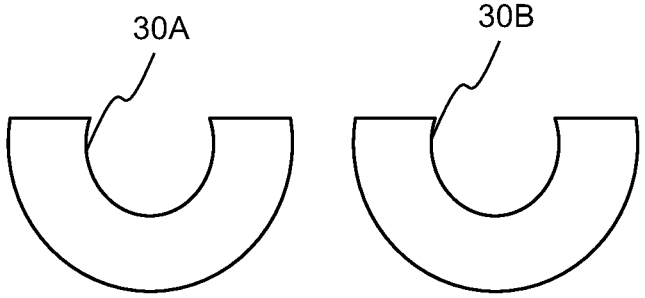
FIGS. 1C and 1D represent a locking mechanism of electronic hub device, according to an embodiment described herein.
Figure 1D:
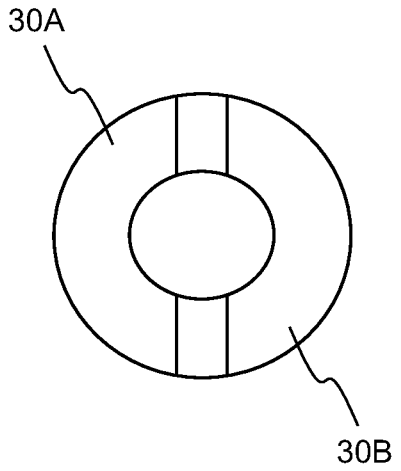

FIGS. 1C and 1D represent a locking mechanism of said electronic hub device 112, according to an embodiment described herein. Locking mechanism, as illustrated in FIGS. 1C and 1D allows for said electronic hub device 12 to stay in place on pole structure of object. Locking mechanism may include "U" shaped locks, such as 30A and 30B as illustrated in FIG. 1C. Locks 30A and 30B may be adjustable and may circle around pole structure of object, as illustrated in FIG. 1D. Locks 30A and 30B may be designed to fit all sizes of pole structures of different objects and may be locked and unlocks very easily through various fastening mechanisms, such as snap fitting or friction fitting. Locks 30A and 30B may be attached towards bottom of said electronic hub device 12 to provide a support and prevent it from falling down.

Figure 2:
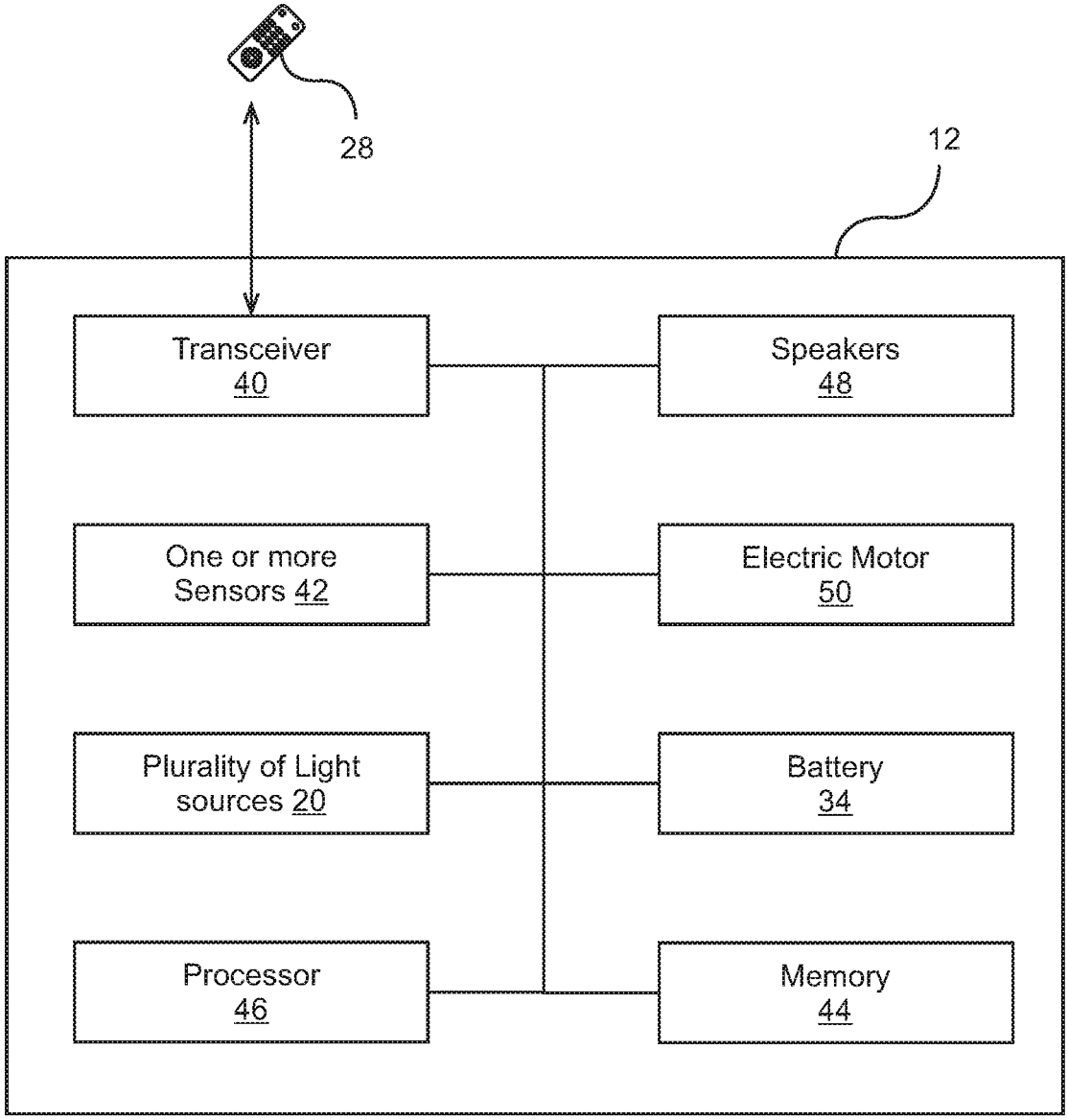
FIG. 2 represents a block diagram of electronic hub device, according to an embodiment described herein.

FIG. 2 illustrates a block diagram of said electronic hub device 12, according to various embodiments described herein. Electronic hub device 12 may include a transceiver 40, one or more sensors 42, a memory 44, a processor 46, speakers 48, and electric motor 50, in addition to a plurality of light sources 20, remote device 28, and battery 34 described above in FIGS. 1 and 1A.

Transceiver 40 may be configured to implement known technologies to support wireless communication, for example infrared protocols, to receive infrared signals from other devices, such as said remote device 28. Transceiver 40 may also be configured to support other short distance wireless communication protocols, such as Bluetooth protocols, while pairing said speakers 48 with external portable devices.

One or more said sensors 42, such as motion sensor, a light sensor, camera sensor, audio sensor, proximity sensor or pressure sensor, may be configured to detect one or more events around said electronic hub device 12, and cause said processor 46 to activate, for example at least said plurality of light sources 20, located on said frame 14, based on detected one or more events.

Processor 46, as described above, may be configured to activate said plurality of sources 20, located on said upper surface 16 of said frame 14, based on detected one or more events. Processor 46 may be further configured to activate said electric motor 50 installed at said lower surface 18 of inner portion of said frame 14. Processor 46 may be further configured to activate said speakers 48 installed on said upper surface 16 of inner portion 14B of said frame 14. Further, said processor 46 may be configured to generate an alert notification based on one or more critical events, such as low battery or loose connection event. Such generated alert notifications are rendered by I/O devices, such as flash light, beeper, and/or the like. Processor 46 may be an X86-based processor, a Reduced Instruction Set Computing (RISC) processor, an Application-Specific Integrated Circuit (ASIC) processor, a Complex Instruction Set Computing (CISC) processor, a microcontroller, a central processing unit (CPU), a digital signal processor (DSP), a coprocessor, and/or other processors or integrated circuits.

Speakers 48 may correspond to wireless speaker device 24 configured to be paired with one or more portable devices associated with one or more users and generate an audio output. In an embodiment, said speakers 48 may be installed at inner portion 14B of said upper surface 16 of said frame 14 and may be activated based on an activation signal received from said processor 46.

Electric motor 50 may be installed at inner portion 14B of said frame 14 and may be configured to rotate said frame 14 about a central axis of said frame 14 around pole structure of object upon receiving an activation signal from said processor 46. Electric motor 50 may be engaged with inner portion 14B of said frame 14 through a gear and belt assembly, wherein inner portion 14B is engaged with pole structure through a bearing assembly (not shown). In an embodiment, activation signal may be initiated by said processor 46 based on an infrared command received from said remote device 28.

Battery 34 may be configured to provide power to said plurality of light sources 20 and other electronic and electrical components of said electronic hub device 12. In an embodiment, said battery 34 may be powered from an external power supply via power cable 36, as illustrated in FIG. 1. In an embodiment, said battery 34 may be a lithium-ion battery that is small, durable, and having long life. Alternatively, battery 34 may be a chargeable battery that may be recharged when power level drops below a threshold power level.

Memory 44 may be configured to temporarily store various data, such as energization pattern of said plurality of light sources 20 and plurality of pre-recorded music files that may be retrieved by said processor 46 based on a selection provided by a user via said remote device 28.

Figure 4:
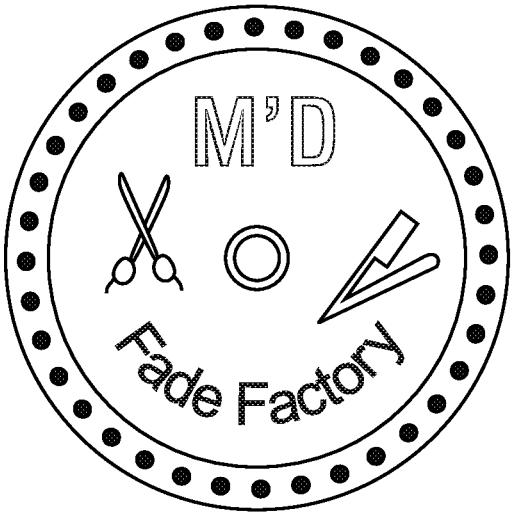
FIGS. 4-4I represent use cases illustrating implementation of electronic hub device, according to an embodiment described herein.
Figure 4A:
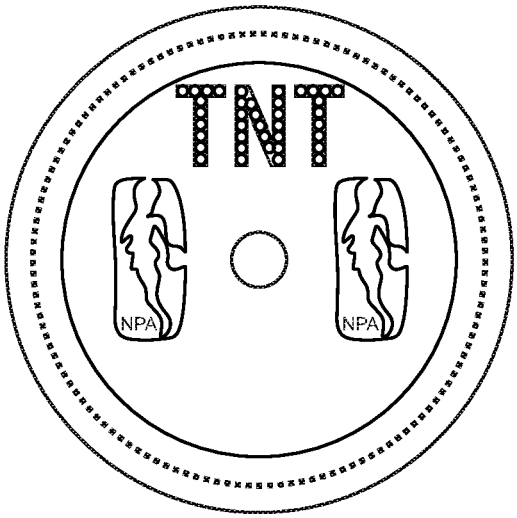
Figure 4B:
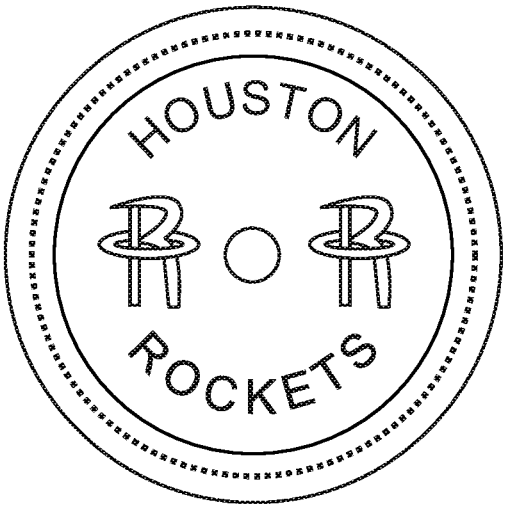
Figure 4C:
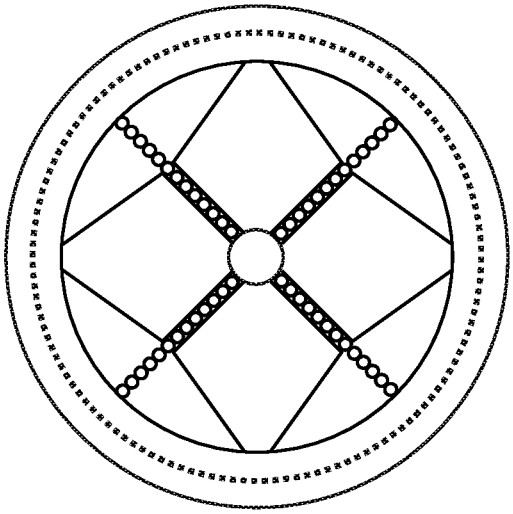
Figure 4D:
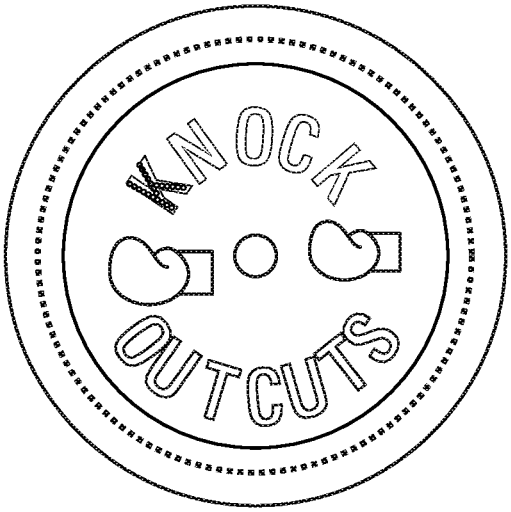
Figure 4E:
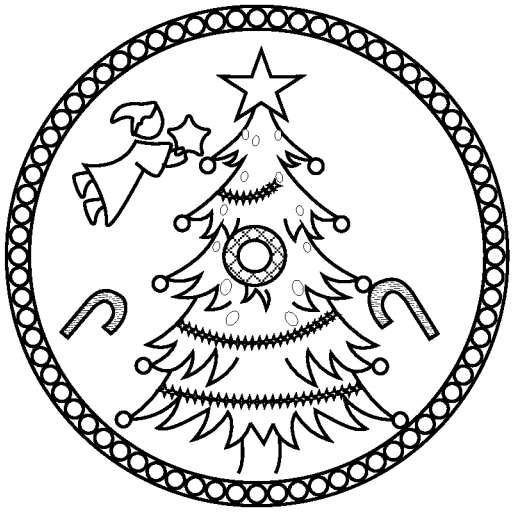
Figure 4F:
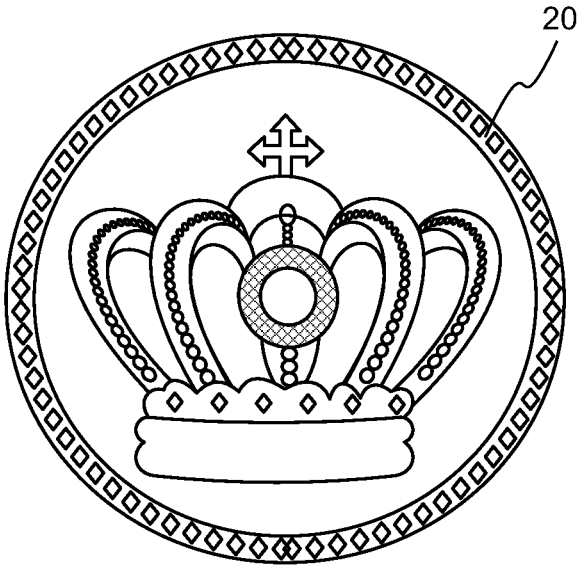
Figure 4G:
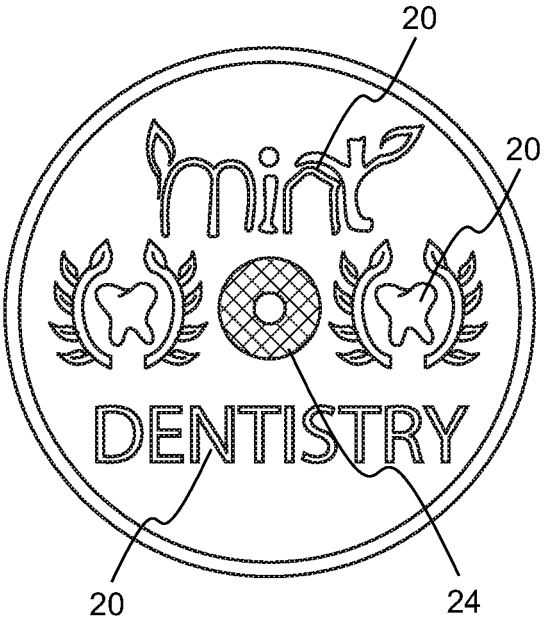
Figure 4H:
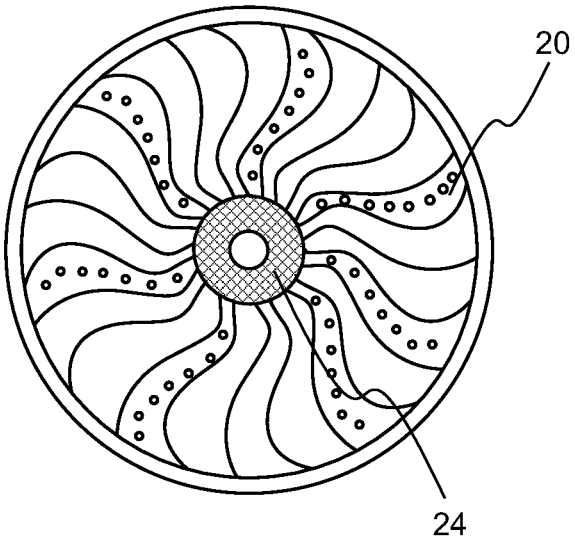
Figure 4I:
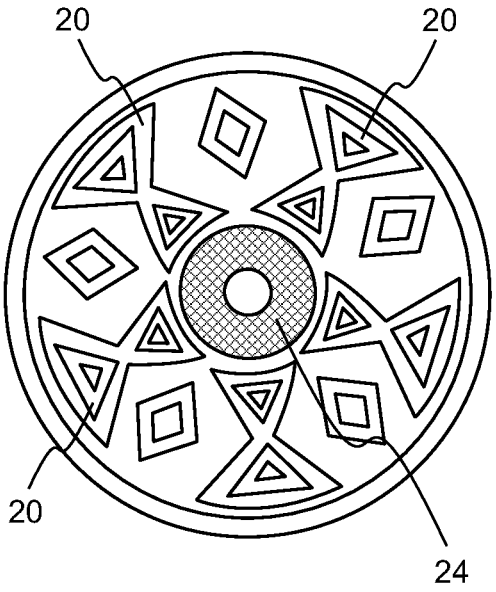

FIGS. 3-3D represents multiple objects upon which said electronic hub device 12 may be mounted, according to various embodiments described herein. FIGS. 4-4I represent use cases illustrating implementation of electronic hub device 12, according to various embodiments described herein.

Referring to FIG. 3, there is shown a first object, such as a salon chair 60A having a round base upon which a pole structure 62A is mounted. Towards upper end of said pole structure 62A, there is mounted a seating arrangement 64A. Electronic hub device 12 may be mounted on said pole structure 62A at a defined height from base of said salon chair 60A. In an example use case, when a customer enters salon and proceeds towards said salon chair 60A, a proximity sensor detects presence of customer and automatically switches on and illuminates said plurality of light sources 20. A pre-stored promotional voice message may be rendered via speakers 48. Plurality of light sources 20 may be illuminated according to a pattern selected by salon owner via remote device 28. Electronic hub device 12 may also start rotating upon receiving an activation signal from processor 46. Processor 46 may generate activation signal based on a command received from said remote device 28 in response to selection of a button on said remote device 28 by salon owner. In an instance, portion of said frame 14 of said electronic hub device 12 may include promotional content selected based on preferences of salon owner, for example, aesthetic design shown in FIG. 4.

Notwithstanding, the disclosure may not be limited to salon chair, as described above in exemplary use case. Electronic hub device 12 may be mounted on other types of chairs, such as office chair, game chair, or other such chairs having a pole structure. In such instances, portion of said frame 14 of said electronic hub device 12 may include promotional content selected based on preferences of employee, a game player, or other such user, for example, aesthetic designs shown in FIGS. 4A, 4B, and 4D. It may be noted that employee, game player, or other such user may further customize aesthetic design of electronic hub device, based on preferences.

Referring to FIG. 3A, there is shown a second object, such as a standing fan 60B, having a round base upon which a pole structure 62B is mounted. Towards upper end of said pole structure 62B, there is mounted a fan assembly 64B. Electronic hub device 12 may be mounted on said pole structure 62B at a defined height from base of said standing fan 60B placed in a facility, such as at home of a user. In an example use case, when user heads towards said standing fan 60B, a proximity sensor detects presence of user and automatically switches on and illuminates said plurality of light sources 20. A pre-stored promotional voice message may be rendered via said speakers 48. Plurality of light sources 20 may be illuminated according to a default pattern. Electronic hub device 12 may also start rotating upon receiving an activation signal from said processor 46. Processor 46 may generate activation signal based on a command received from said remote device 28 in response to selection of a button on said remote device 28 by user. User may further pair a portable device with said speakers 48 and play favorite playlist. In an instance, portion of said frame 14 of said electronic hub device 12 may include promotional content selected based on preferences of user, for example, aesthetic design shown in FIG. 4C.

Referring to FIG. 3B, there is shown a third object, such as a Christmas tree 60C, having base legs upon which a pole structure 62C is mounted. Towards upper end of said pole structure 62C, there is mounted leaves and decorative items 64C. Electronic hub device 12 may be mounted on said pole structure 62C at a defined height from base of said Christmas tree 60C placed in a facility, such as at home of a user. In an example use case, when user moves near said Christmas tree 60C, a motion sensor detects movement of user and automatically switches on and illuminates said plurality of light sources 20. Pre-stored Christmas jingles may be rendered via said speakers 48. Plurality of light sources 20 may be illuminated according to a default pattern. The plurality of light sources 20 may be set to synchronize with jingles, sounds or music emitted from said speakers 48. Electronic hub device 12 may also start rotating upon receiving an activation signal from said processor 46. Processor 46 may generate activation signal based on a command received from said remote device 28 in response to selection of a button on said remote device 28 by user. In an instance, portion of said frame 14 of said electronic hub device 12 may include festive content selected based on preferences of user, for example, aesthetic design shown in FIG. 4E.

Referring to FIG. 3C, there is shown a fourth object, such as an office chair 60D, having base legs upon which a pole structure 62D is mounted. Towards upper end of said pole structure 62D, there is a mounted seat 64D. Electronic hub device 12 may be mounted on said pole structure 62D proximate to legs of said office chair 60D placed in a facility, such as at office of a user. In an example use case, when user moves near said office chair 60D, a motion sensor detects movement of user and automatically switches on and illuminates said plurality of light sources 20 in an extending pattern from center towards periphery (FIG. 4H) or selective illumination in parts (FIG. 4I). Pre-stored soothing music may be rendered via speakers 48. In an instance, portion of said frame 14 of said electronic hub device 12 may include a geometric, for example, aesthetic design shown in FIGS. 4H and 4I.

Referring to FIG. 3D, there is shown a fifth object, such as a clinical chair 60E, having base legs upon which a pole structure 62E is mounted. Towards upper end of said pole structure 62E, there is amounted seat 64E. Electronic hub device 12 may be mounted on said pole structure 62E covering legs of said clinical chair 60E placed in a facility, such as a hospital or clinic. In an example use case, when patient moves near said clinical chair 60E, a motion sensor detects movement of patient and automatically switches on and illuminates said plurality of light sources 20 along perimeter of said electronic hub device 12 (FIG. 4G) or in text or graphic portions (FIG. 4G). Pre-stored soothing music may be rendered via said speakers 48. In an instance, portion of said frame 14 of said electronic hub device 12 may include various pattern, for example, aesthetic design shown in FIGS. 4H and 4I.

Figure 5:
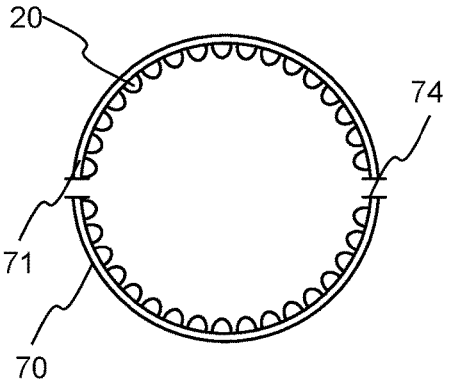
FIG. 5 illustrates the bottom ring of an embodiment of the present invention, said bottom ring can be of any shape or size.
Figure 6:
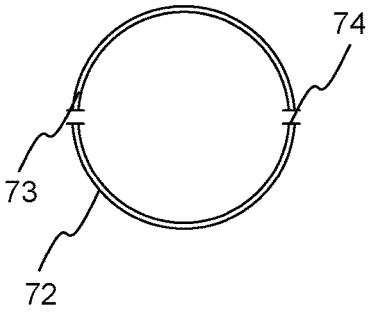
FIG. 6 illustrates the top ring of an embodiment of the present invention, said top ring can be of any shape or size.
Figure 7:
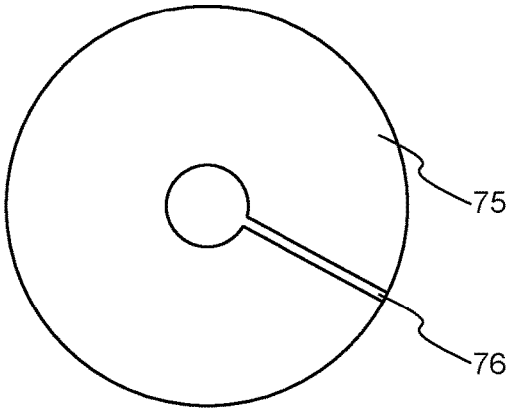
FIG. 7 illustrates a poster to be used with the bottom and top ring of FIG. 5 and FIG. 6, said poster can be of any shape or size.
Figure 8:
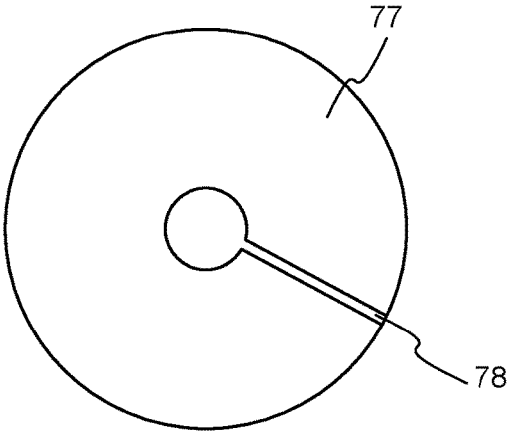
FIG. 8 illustrates a transparent cover adapted to protect the posters used in alternate embodiments of the present invention, said transparent cover can be of any shape or size.

Referring to FIG. 5 and FIG. 6, there is seen at least two rings which are usable in an alternate embodiment of the present invention. The bottom ring 70 is the base ring as it is the larger of the two rings. The top ring 72 is the smaller ring. Bottom ring 70 and said top ring 72 can be of any shape or size. The name "ring" is not to imply that they must be circular in shape. Importantly, this embodiment uses a poster 75, seen in FIG. 7, of any material, such as plastic, paper, or vinyl for example, to depict any image or advertising that user's desire. This can allow users to change advisements or designs as frequently as they would like. The bottom ring 70 has a bottom ring channel 71 along the circumference of its upper surface, which is where the bottom edge of poster 75 can slip into to be secured. The top ring 72, similarly, has a top ring channel 73 along its circumference, but along its lower surface. This is where the top edge of poster 75 can slide into. The poster 75 is extended by being in-between said bottom ring 70 and said top ring 72. Further, said bottom ring 70 and said top ring 72 can be retrofitted onto chairs of any shape or size as they come apart. Each of said bottom ring 70 and said top ring 72 splits into two parts. These two parts can come together around chairs of any shape or size with the use of connectors 74. The connectors 74 can be any means suitable depending on the size of the present invention. The poster 75 is also possible to use on any sized or shape chair as there is a use of a poster slit 76 that may go around any chair base. Additionally, said poster 75 can be of any shape or size as to properly fit into said bottom ring 70 and top ring 72 of different shape and/or sizes. Furthermore, said bottom ring 70 has a plurality of light sources 20 around its circumference as well. The plurality of light sources 20 can make the poster 75 colorful, bright or bring attention to details users desire. There is also a transparent cover 77, seen in FIG. 8, that may be used in this embodiment. The transparent cover 77 has a cover slit 78 that allows it to slip into place around chair bases of any shape or size and over said poster 75 as well. The transparent cover 77 may reduce the amount of possible damage that said poster 75 may receive. Being that the present invention in this embodiment can take on any predetermined shape or size, it should be assumed that said transparent cover 77 can as well.

Figure 9:
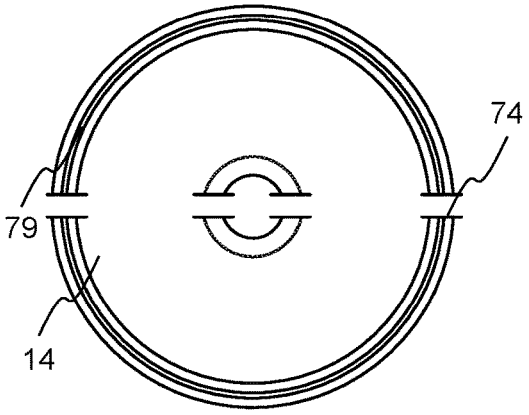
FIG. 9 illustrates a top view of a hub in an embodiment of the present invention that makes use of a poster.

In FIG. 9, an additional alternate embodiment can be seen. In this embodiment there is a use of a frame 14 similarly to aforementioned embodiments. However, designs do not go directly onto said frame 14 of said electric hub device 12. Instead, said frame 14 can be used as a surface for a poster 75, which can be seen in FIG. 7, used to advertise or express creativity as the users desire. The poster 75 can be of any material selected by the user, such as plastic, paper or vinyl, and can go on said frame 14. The poster 75 can be frequently changed as the user wishes. The poster 75 is secured onto the electronic hub device 12 by sliding into a slit 79 found on the upper surface about the circumference of the embodiment of FIG. 9. Additionally, said poster 75 may be further secured onto said frame 14 through the use of an adhesive. This embodiment may use a plurality of light sources 20 on the circumference of the electronic hub device 12 or it can be used as a lightbox wherein light is used underneath said frame 14 to bring color or brightness to the present invention. Although said electronic hub device 12 is depicted as round it can be retrofitted onto chairs of any shape or size. This is because said electronic hub device 12 can take on any shape or size. Being so, said poster 75 can also be any predetermined shape or size in order to fit into the said electronic hub device 12 of predetermined size and shape properly. Further, said electric hub device 12 can be pulled apart into two parts to fit around chair bases of various sizes. These two parts can come together with the use of connectors 74. Additionally, there is the use of a transparent cover 77, seen in FIG. 8, that may reduce the amount of damage that said poster 75 may receive. The transparent cover 77 has a slit which may be used to slide said transparent cover 77 into place over said poster 75 and said frame 14. Being that the present invention in this embodiment can take on any predetermined shape or size, it can be appreciated that said transparent cover 77 can as well.

The disclosed said electronic hub device 12 is an easy-to-install decorative article that may be snapped over a base of a pedestal chair or office desk or computer chair to promote a business through aesthetic appeal. Artistic expression evident in chair would enhance the way one looks at chair. There are many advantages of electronic hub device 12. For example, said electronic hub device 12 enables individuals and companies to bring their brand to life with creativity. Electronic hub device 12 makes it possible to showcase one's personality and bring ordinary hub objects to life. Electronic hub device 12 gives user a "superstar" effect. Electronic hub device 12 may be used for advertisement purposes also.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An electronic hub device, comprising:

a first ring being a bottom ring and a second ring being a top ring, wherein said first ring is larger than said second ring, wherein said first ring includes a bottom ring channel along a circumference of an upper surface of said first ring, wherein said second ring includes a top ring channel along a circumference of a lower surface of said second ring, wherein said first ring and said second each split into two parts, wherein said first ring and second ring are mounted onto a vertical structure, wherein said second ring is entirely above said first ring;

a poster being a sheet that is extended in-between said at least two rings, wherein said poster includes a bottom edge which slips into said bottom ring channel to be securely mounted thereon, said poster including a top edge which slips into said top ring channel to be securely mounted thereon, wherein said poster is extended between said first ring and said second ring, said poster further including a poster slit;

a plurality of light sources; and a transparent cover wherein said transparent cover is placed over said poster configured to provide a protective outer layer to said poster.

2. The electronic hub device of claim 1, wherein said plurality of light sources are mounted along an inner edge of said bottom ring.

3. The electronic hub device of claim 1, wherein said at least two rings are of a predetermined shape and size allowing said electronic hub device to be retrofitted onto a chair.

4. The electronic hub device of claim 1, wherein each of said two parts include connectors mounted thereon to create a secure attachment.

5. The electronic hub device of claim 1, wherein said poster slit extends from said top edge to said bottom edge.

* * * * *